US009950360B2

(12) United States Patent
Tilak et al.

(10) Patent No.: US 9,950,360 B2
(45) Date of Patent: Apr. 24, 2018

(54) PROCESS AND APPARATUS FOR MINIMIZING THE POTENTIAL FOR EXPLOSIONS IN THE DIRECT CHILL CASTING OF LITHIUM ALLOYS

(71) Applicant: Almex USA, Inc., Buena Park, CA (US)

(72) Inventors: Ravindra V. Tilak, Orange, CA (US); Rodney W. Wirtz, Lake Forest, CA (US); Ronald M. Streigle, Anaheim, CA (US)

(73) Assignee: Almex USA, Inc., Buena Park, CA (US)

( * ) Notice: Subject to any disclaimer, the term of this patent is extended or adjusted under 35 U.S.C. 154(b) by 0 days.

(21) Appl. No.: 15/479,996

(22) Filed: Apr. 5, 2017

(65) Prior Publication Data

US 2017/0209919 A1 Jul. 27, 2017

Related U.S. Application Data

(60) Division of application No. 14/761,735, filed as application No. PCT/US2014/014735 on Feb. 4,
(Continued)

(51) Int. Cl.
*B22D 11/049* (2006.01)
*B22D 11/14* (2006.01)
(Continued)

(52) U.S. Cl.
CPC ..... *B22D 11/22* (2013.01); *B22D 11/003* (2013.01); *B22D 11/049* (2013.01);
(Continued)

(58) Field of Classification Search
CPC . B22D 11/049; B22D 11/124; B22D 11/1248; B22D 11/148; B22D 11/16; B22D 11/18
(Continued)

(56) References Cited

U.S. PATENT DOCUMENTS 2,286,481 A 7/1940 Fisher
2,863,558 A 12/1958 Brondyke et al.
(Continued)

FOREIGN PATENT DOCUMENTS

CA 1309870 11/1992
CN 1059484 3/1992
(Continued)

OTHER PUBLICATIONS

Almex USA, Inc., "Final Office Action", JP Application No. 2015-512865, (dated Jul. 26, 2017).
(Continued)

*Primary Examiner* — Kevin E Yoon
(74) *Attorney, Agent, or Firm* — Womble Bond Dickinson (US) LLP

(57) ABSTRACT

An apparatus and a system including a casting pit; a mold including a reservoir and a cavity; a coolant feed operable to introduce a coolant to a periphery of a metal emerging from the mold cavity; an array of water vapor exhaust ports about at least the top periphery of the casting pit; a mechanism to introduce an inert fluid into the coolant feed. A method for a direct chill casting including, after detecting a bleed out, exhausting generated gas from the casting pit at a flow volume rate that is enhanced relative to a flow volume rate prior to detecting bleed out or run out; introducing an inert gas into the casting pit; and introducing an inert fluid into a coolant feed to the casting mold.

16 Claims, 5 Drawing Sheets

Related U.S. Application Data

2014, now Pat. No. 9,616,493, which is a continuation of application No. PCT/US2013/041457, filed on May 16, 2013, and a continuation of application No. PCT/US2013/041459, filed on May 16, 2013, and a continuation of application No. PCT/US2013/041464, filed on May 16, 2013.

(60) Provisional application No. 61/760,323, filed on Feb. 4, 2013, provisional application No. 61/908,065, filed on Nov. 23, 2013.

(51) Int. Cl.

| | |
|---|---|
| ***B22D 11/22*** | (2006.01) |
| ***B22D 11/16*** | (2006.01) |
| ***B22D 11/18*** | (2006.01) |
| ***B22D 11/00*** | (2006.01) |
| ***B22D 11/124*** | (2006.01) |
| ***C22C 21/00*** | (2006.01) |
| ***B22D 11/055*** | (2006.01) |

(52) U.S. Cl.

CPC ..... *B22D 11/055* (2013.01); *B22D 11/124* (2013.01); *B22D 11/1248* (2013.01); *B22D 11/14* (2013.01); *B22D 11/141* (2013.01); *B22D 11/148* (2013.01); *B22D 11/16* (2013.01); *B22D 11/18* (2013.01); *C22C 21/00* (2013.01)

(58) Field of Classification Search

USPC ..... 164/151.5, 415, 444, 452, 475, 486, 487

See application file for complete search history.

(56) References Cited

U.S. PATENT DOCUMENTS

| | | | |
|---|---|---|---|
| 3,006,473 | A | 10/1961 | Gamber |
| 3,235,089 | A | 2/1966 | Burroughs |
| 3,281,238 | A | 10/1966 | Bachowski et al. |
| 3,320,348 | A | 5/1967 | Seulen et al. |
| 3,335,212 | A | 8/1967 | Seulen et al. |
| 3,451,465 | A | 6/1969 | Moritz et al. |
| 3,524,548 | A | 8/1970 | McDonald et al. |
| 3,800,856 | A | 4/1974 | Mizikar et al. |
| 3,834,445 | A | 9/1974 | Raschke |
| 3,895,937 | A | 7/1975 | Gjosteen et al. |
| 3,947,363 | A | 3/1976 | Pryor et al. |
| 4,113,241 | A | 9/1978 | Dore |
| 4,188,884 | A | 2/1980 | White et al. |
| 4,214,624 | A | 7/1980 | Foye et al. |
| 4,221,589 | A | 9/1980 | Verstraelen |
| 4,237,961 | A | 12/1980 | Zinniger |
| 4,248,630 | A | 2/1981 | Balmuth |
| 4,355,679 | A | 10/1982 | Wilkins |
| 4,395,333 | A | 7/1983 | Groteke |
| 4,427,185 | A | 1/1984 | Meyer |
| 4,444,377 | A | 4/1984 | Groteke et al. |
| 4,501,317 | A | 2/1985 | Sokolowski |
| 4,524,819 | A | 6/1985 | Yoshimura |
| 4,527,609 | A | 7/1985 | Nugent |
| 4,528,099 | A | 7/1985 | Rieger et al. |
| 4,553,604 | A | 11/1985 | Yaji et al. |
| 4,556,535 | A | 12/1985 | Bowman et al. |
| 4,567,936 | A | 2/1986 | Binczewski |
| 4,581,295 | A | 4/1986 | DeLiso et al. |
| 4,582,118 | A | 4/1986 | Jacoby et al. |
| 4,593,745 | A | 6/1986 | Yu et al. |
| 4,597,432 | A | 7/1986 | Collins et al. |
| 4,598,763 | A | 7/1986 | Wagstaff et al. |
| 4,607,679 | A | 8/1986 | Tsai et al. |
| 4,610,295 | A | 9/1986 | Jacoby et al. |
| 4,628,985 | A | 12/1986 | Jacoby et al. |
| 4,640,497 | A | 2/1987 | Heamon |
| 4,651,804 | A | 3/1987 | Grimes et al. |
| 4,709,740 | A | 12/1987 | Jacoby et al. |
| 4,709,747 | A | 12/1987 | Yu et al. |
| 4,724,887 | A | 2/1988 | Jacoby et al. |
| 4,761,266 | A | 8/1988 | Bruski |
| 4,769,158 | A | 9/1988 | Eckert |
| 4,770,697 | A | 9/1988 | Zurecki |
| 4,773,470 | A | 9/1988 | Libby et al. |
| 4,781,239 | A | 11/1988 | Cans et al. |
| 4,809,866 | A | 3/1989 | Greene et al. |
| 4,858,674 | A | 8/1989 | Enright |
| 4,930,566 | A | 6/1990 | Yanagimoto et al. |
| 4,947,925 | A | 8/1990 | Wagstaff et al. |
| 4,964,993 | A | 10/1990 | Stankiewicz |
| 4,986,337 | A | 1/1991 | Soulier |
| 4,987,950 | A | 1/1991 | Yu |
| 5,028,570 | A | 7/1991 | Winkelbauer et al. |
| 5,032,171 | A | 7/1991 | Robare et al. |
| 5,052,469 | A | 10/1991 | Yanagimoto et al. |
| 5,091,149 | A | 2/1992 | Shin et al. |
| 5,148,853 | A | 9/1992 | Yu et al. |
| 5,167,918 | A | 12/1992 | Shin et al. |
| 5,176,197 | A | 1/1993 | Hamaguchi et al. |
| 5,185,297 | A | 2/1993 | Park et al. |
| 5,212,343 | A | 5/1993 | Brupbacher et al. |
| 5,320,803 | A | 6/1994 | Webster |
| 5,369,063 | A | 11/1994 | Gee |
| 5,404,813 | A | 4/1995 | Wong |
| 5,415,220 | A | 5/1995 | Edwards |
| 5,427,602 | A | 6/1995 | DeYoung et al. |
| 5,441,919 | A | 8/1995 | Park et al. |
| 5,548,520 | A | 8/1996 | Nakamura et al. |
| 5,845,481 | A | 12/1998 | Briesch et al. |
| 5,846,481 | A | 12/1998 | Tilak |
| 5,873,405 | A | 2/1999 | Carrier et al. |
| 6,069,910 | A | 5/2000 | Eckert |
| 6,148,018 | A | 11/2000 | Garcia et al. |
| 6,279,645 | B1 | 8/2001 | McGlade et al. |
| 6,393,044 | B1 | 5/2002 | Fishman et al. |
| 6,398,844 | B1 | 6/2002 | Hobbs et al. |
| 6,446,704 | B1 | 9/2002 | Collins |
| 6,491,087 | B1 | 12/2002 | Tilak |
| 6,551,424 | B1 | 4/2003 | Haszler et al. |
| 6,675,870 | B2 | 1/2004 | Tilak |
| 6,808,009 | B2 | 10/2004 | Anderson |
| 6,837,300 | B2 | 1/2005 | Cooper et al. |
| 7,000,676 | B2 | 2/2006 | Chu et al. |
| 7,204,295 | B2 | 4/2007 | Schneider et al. |
| 7,296,613 | B2 | 11/2007 | Anderson et al. |
| 7,550,028 | B2 | 6/2009 | Riquet et al. |
| 8,056,611 | B2 | 11/2011 | Gildemeister et al. |
| 8,196,641 | B2 | 6/2012 | Jacques et al. |
| 8,365,808 | B1 | 2/2013 | Tilak et al. |
| 8,479,802 | B1 | 7/2013 | Tilak et al. |
| 9,616,493 | B2 | 4/2017 | Tilak et al. |
| 2007/0074846 | A1 | 4/2007 | Sommerhofer et al. |
| 2009/0269239 | A1 | 10/2009 | Nagakura et al. |
| 2011/0049197 | A1 | 3/2011 | Withey et al. |
| 2011/0209843 | A2 | 9/2011 | Bes et al. |
| 2011/0247456 | A1 | 10/2011 | Rundquist et al. |
| 2012/0237395 | A1 | 9/2012 | Jarry |
| 2012/0300806 | A1 | 11/2012 | Prabhu et al. |
| 2015/0139852 | A1 | 5/2015 | Tilak et al. |
| 2015/0147227 | A1 | 5/2015 | Tilak |
| 2016/0242239 | A1 | 8/2016 | Prabhu et al. |

FOREIGN PATENT DOCUMENTS

| | | |
|---|---|---|
| CN | 1064034 | 9/1992 |
| CN | 1611311 | 5/2005 |
| CN | 1925938 | 3/2007 |
| CN | 101428334 | 5/2009 |
| CN | 101648265 | 2/2010 |
| CN | 101712071 | 5/2010 |
| CN | 101967588 | 2/2011 |
| CN | 101984109 | 3/2011 |
| CN | 201892583 | 7/2011 |
| CN | 102699302 | 10/2012 |
| CN | 104470655 | 3/2017 |

(56) References Cited

FOREIGN PATENT DOCUMENTS

| | | |
|---|---|---|
| CN | 105008064 | 6/2017 |
| DE | 4328045 | 2/1995 |
| EP | 0090583 | 10/1983 |
| EP | 0109170 | 5/1984 |
| EP | 0142341 | 5/1985 |
| EP | 0150922 | 8/1985 |
| EP | 0183563 | 6/1986 |
| EP | 0229211 | 7/1987 |
| EP | 0229218 | 7/1987 |
| EP | 0281238 | 9/1988 |
| EP | 0295008 | 12/1988 |
| EP | 0364097 | 4/1990 |
| EP | 0402692 | 12/1990 |
| EP | 0497254 | 8/1992 |
| EP | 0726114 | 8/1996 |
| EP | 1045216 | 10/2000 |
| EP | 2664397 | 3/2016 |
| GB | 2281312 | 3/1995 |
| JP | 62176642 | 8/1987 |
| JP | 1233051 | 9/1989 |
| JP | 4313455 | 11/1992 |
| JP | 557400 | 3/1993 |
| JP | 8268745 | 10/1996 |
| RU | 2048568 | 11/1995 |
| RU | 2261933 | 10/2005 |
| RU | 2377096 | 12/2009 |
| RU | 2381865 | 2/2010 |
| WO | WO-8702069 | 4/1987 |
| WO | WO-2010094852 | 8/2010 |
| WO | WO-2013173649 | 11/2013 |
| WO | WO-2014121297 | 8/2014 |

OTHER PUBLICATIONS

Almex USA, Inc., "Non final office action", U.S. Appl. No. 14/401,107, (dated Jun. 12, 2017).
Almex USA, Inc., "Non final office action", U.S. Appl. No. 14/546,681, (dated Jun. 23, 2017).
Almex USA, Inc., "Notice of Allowance", U.S. Appl. No. 14/401,813, (dated Jun. 9, 2017).
Almex USA, Inc., "Office Action", RU Application No. 2014150995, (dated May 18, 2017).
Almex USA, Inc., "Office Action", RU Application No. 2014150998, (dated May 19, 2017).
Almex USA, Inc., "Second Office Action", CN Application No. 201480001852,0, (dated May 15, 2017).
"Semi-Continuous Casting Plant Produces Aluminum-Lithium Alloys" *Met. Ind. News 3*, (Sep. 1986) Abstract.
Almex USA, Inc., "European extended search report", EP Application No. 13150674.3, (dated Nov. 18, 2013).
Almex USA, Inc., "European extended search report", EP Application No. 14198973.1, (dated May 7, 2015).
Almex USA, Inc., "European Search Report", EP Application No. 16182786.0, (dated Dec. 15, 2016).
Almex USA, Inc., "First Office Action", CN Application No. 201480007290.0, (dated Aug. 1, 2016).
Almex USA, Inc., "International preliminary report on patertability", PCT Application No. PCT/US2014/014735, (dated Jul. 10, 2015).
Almex USA, Inc., "International Preliminary Report on Patentability", PCT Application No. PCT/US2014/014737, (dated Jul. 10, 2015).
Almex USA, Inc., "International preliminary report on patertability", PCT Application No. PCT/US2013/041459, (dated Nov. 27, 2014).
Almex USA, Inc., "International preliminary report on patentability", PCT Application No. PCT/US2013/041457, (dated Nov. 27, 2014).
Almex USA, Inc., "International Preliminary Report on Patentability", PCT Application No. PCT/US2013/041464, (dated Nov. 27, 2014).
Almex USA, Inc., "International Search Report and Written Opinion", PCT Application No. PCT/US2013/041464, (dated Nov. 27, 2013).
Almex USA, Inc., "International Search Report and Written Opinion", PCT Application No. PCT/US2013/041459, (dated Dec. 2, 2013).
Almex USA, Inc., "International Search Report and Written Opinion", PCT Application No. PCT/US2014/014737, (dated Jun. 17, 2014).
Almex USA, Inc., "International Search Report and Written Opinion", PCT Application No. PCT/US2014/014735, (dated Jun. 17, 2014).
Almex USA, Inc., "Invitation to pay additional fees", PCT Application No. PCT/US2014/066755, (dated Feb. 26, 2015).
Almex USA, Inc., "Non final office action", U.S. Appl. No. 13/474,616, (dated Nov. 6, 2012).
Almex USA, Inc., "Non final office action", JP Application No. 2015-512865, (dated Feb. 20, 2017).
Almex USA, Inc., "Office action with search report", CN Application No. 201480001852.0, (dated Sep. 1, 2016).
Almex USA, Inc., "Third Office Action", CN Application No. 201380037685.0, (dated Feb. 16, 2017).
Almex USA, Inc., "Written Opinion", PCT Application No. PCT/US2014/014735, (dated Feb. 20, 2015).
Almex USA, Inc., "Written Opinion", PCT Application No. PCT/US2014/014737, (dated Feb. 20, 2015).
Anonymous, "Concise description of relevance", U.S. Appl. No. 14/546,681, (Feb. 17, 2016).
Anonymous, "Explanation of Relevance", PCT Application No. PCT/US2014/066755, (Feb. 10, 2016).
Anonymous, "PCT third party observation", PCT Application No. PCT/US2014/066755, (Feb. 10, 2016).
Anonymous, "Third party submission", U.S. Appl. No. 14/546,681, (Feb. 17, 2016).
Gorss, J. B., et al., "Design and operation experience with a coreless inductor furnace for melting aluminum", 12th ABB Conference on Induction Furnaces, Dortmund, Germany, (Apr. 17-18, 1991) pp. 301-313.
Heine, H. G., et al., "Coreless Induction Melting of Aluminum", Light Metal Age, (Feb. 1991) pp. 18-23.
Nair, C. G., et al., "Technology for Aluminum-Lithium Alloy Production—Ingot Casting Route", Science and Technology of Aluminum-Lithium Alloys, Bangalore, India, (Mar. 4-5, 1989) Abstract.
Ohara, K., et al., "Hot-tearing of Al—Li alloys in DC casting", 4th International Conference on Aluminum Alloys: Their Physical and Mechanical Properties, vol. II, (Sep. 11-16, 1994) Abstract.
Page, F. M., et al., "The Safety of Molten Aluminum-Lithium Alloys in the Presence of Coolants", Journal de Physique 48, Supplement No. 9, (Sep. 1987) C3-63-C3-73.
Almex USA, Inc., "Non final office action", U.S. Appl. No. 14/401,458, (dated May 10, 2017).

PROCESS AND APPARATUS FOR MINIMIZING THE POTENTIAL FOR EXPLOSIONS IN THE DIRECT CHILL CASTING OF LITHIUM ALLOYS

CROSS-REFERENCE TO RELATED APPLICATION

The application is divisional of co-pending U.S. patent application Ser. No. 14/761,735, filed Jul. 17, 2015, which is a 371 application of International Application No. PCT/US2014/014735, filed Feb. 4, 2014, which claims the benefit of the earlier filing date of U.S. Provisional Application No. 61/760,323, filed Feb. 4, 2013; International Application No. PCT/US2013/041457, filed May 16, 2013; International Application No. PCT/US2013/041459, filed May 16, 2013; International Application No. PCT/US2013/041464, filed May 16, 2013; and U.S. Provisional Application No. 61/908,065, filed Nov. 23, 2013, all of which are incorporated herein by reference.

FIELD

Direct chill casting of aluminum lithium (Al—Li) alloys.

BACKGROUND

Traditional (non-lithium containing) aluminum alloys have been semi-continuously cast in open bottomed molds since the invention of Direct Chill ("DC") casting in the 1938 by the Aluminum Company of America (now Alcoa). Many modifications and alterations to the process have occurred since then, but the basic process and apparatus remain similar. Those skilled in the art of aluminum ingot casting will understand that new innovations improve the process, while maintaining its general functions.

U.S. Pat. No. 4,651,804 describes a more modern aluminum casting pit design. It has become standard practice to mount the metal melting furnace slightly above ground level with the casting mold at, or near to, ground level and the cast ingot is lowered into a water containing pit as the casting operation proceeds. Cooling water from the direct chill flows into the pit and is continuously removed there-from while leaving a permanent deep pool of water within the pit. This process remains in current use and, throughout the world, probably in excess of 5 million tons of aluminum and its alloys are produced annually by this method.

Unfortunately, there is inherent risk from a "bleed-out" or "run-out" using such systems. A "bleed out" or "run out" occurs where the aluminum ingot being cast is not properly solidified in the casting mold, and is allowed to leave the mold unexpectedly and prematurely while in a liquid state. Molten aluminum in contact with water during a "bleed-out" or "run-out" can cause an explosion from (1) conversion of water to steam from the thermal mass of the aluminum heating the water to >212° F. or (2) the chemical reaction of the molten metal with the water resulting in release of energy causing an explosive chemical reaction.

There have been many explosions throughout the world when "bleed outs" "run-outs" have occurred in which molten metal escaped from the sides of the ingot emerging from the mold and/or from the confines of the mold, using this process. In consequence, considerable experimental work has been carried out to establish the safest possible conditions for DC casting. Among the earliest and perhaps the best known work was undertaken by G. Long of the Aluminum Company of America ("Explosions of Molten Aluminum in Water Cause and Prevention," Metal Progress, May 1957, Vol. 71, pages 107 to 112) (hereinafter referred to as "Long") that was followed by further investigations and the establishment of industry "codes of practice" designed to minimize the risk of explosion. These codes are generally followed by foundries throughout the world. The codes are broadly based upon Long's work and usually require that: (1) the depth of water permanently maintained in the pit should be at least three feet; (2) the level of water within the pit should be at least 10 feet below the mold; and (3) the casting machine and pit surfaces should be clean, rust free and coated with proven organic material.

In his experiments, Long found that with a pool of water in the pit having a depth of two inches or less, very violent explosions did not occur. However, instead, lesser explosions took place sufficient to discharge molten metal from the pit and distribute this molten metal in a hazardous manner externally of the pit. Accordingly the codes of practice, as stated above, require that a pool of water having a depth of at least three feet is permanently maintained in the pit. Long had drawn the conclusion that certain requirements must be met if an aluminum/water explosion is to occur. Among these was that a triggering action of some kind must take place on the bottom surface of the pit when it is covered by molten metal and he suggested that this trigger is a minor explosion due to the sudden conversion to steam of a very thin layer of water trapped below the incoming metal. When grease, oil or paint is on the pit bottom an explosion is prevented because the thin layer of water necessary for a triggering explosion is not trapped beneath the molten metal in the same manner as with an uncoated surface.

In practice, the recommended depth of at least three feet of water is generally employed for vertical DC casting and in some foundries (notably in continental European countries) the water level is brought very close to the underside of the mold in contrast to recommendation (2) above. Thus the aluminum industry, casting by the DC method, has opted for the safety of a deep pool of water permanently maintained in the pit. It must be emphasized that the codes of practice are based upon empirical results; what actually happens in various kinds of molten metal/water explosions is imperfectly understood. However, attention to the codes of practice has ensured the virtual certainty of avoiding accidents in the event of "run-outs" with aluminum alloys.

In the last several years, there has been growing interest in light metal alloys containing lithium. Lithium makes the molten alloys more reactive. In the above mentioned article in "Metal Progress", Long refers to previous work by H. M. Higgins who had reported on aluminum/water reactions for a number of alloys including Al—Li and concluded that "When the molten metals were dispersed in water in any way Al—Li alloy underwent a violent reaction." It has also been announced by the Aluminum Association Inc. (of America) that there are particular hazards when casting such alloys by the DC process. The Aluminum Company of America has published video recordings of tests that demonstrate that such alloys can explode with great violence when mixed with water.

U.S. Pat. No. 4,651,804 teaches the use of the aforementioned casting pit, but with the provision of removing the water from the bottom of the cast pit such that no buildup of a pool of water in the pit occurs. This arrangement is their preferred methodology for casting Al—Li alloys. European Patent No. 0-150-922 describes a sloped pit bottom (preferably three percent to eight percent inclination gradient of the pit bottom) with accompanying off-set water collection reservoir, water pumps, and associated water level sensors to make sure water cannot collect in the cast pit, thus reducing the incidence of explosions from water and the Al—Li alloy having intimate contact. The ability to continuously remove the ingot coolant water from the pit such that a build-up of water cannot occur is critical to the success of the patent's teachings.

Other work has also demonstrated that the explosive forces associated with adding lithium to aluminum alloys can increase the nature of the explosive energy several times than for aluminum alloys without lithium. When molten aluminum alloys containing lithium come into contact with water, there is the rapid evolution of hydrogen, as the water dissociates to Li—OH and hydrogen ion ($H^+$). U.S. Pat. No. 5,212,343 teaches the addition of aluminum, lithium (and other elements as well) with water to initiate explosive reactions. The exothermic reaction of these elements (particularly aluminum and lithium) in water produces large amounts of hydrogen gas, typically 14 cubic centimeters of hydrogen gas per one gram of aluminum —3% lithium alloy. Experimental verifications of this data can be found in the research carried out under U.S. Department of Energy funded research contract number # DE-AC09-89SR18035. Note that claim 1 of the U.S. Pat. No. 5,212,343 patent claims the method to perform this intense interaction for producing a water explosion via the exothermic reaction. This patent describes a process wherein the addition of elements such as lithium results in a high energy of reaction per unit volume of materials. As described in U.S. Pat. Nos. 5,212,343 and 5,404,813, the addition of lithium (or some other chemically active element) promotes an explosion. These patents teach a process where an explosive reaction is a desirable outcome. These patents reinforce the explosiveness of the addition of lithium to the "bleed-out" or "run-out", as compared to aluminum alloys without lithium.

Referring again to the U.S. Pat. No. 4,651,804, the two occurrences that result in explosions for conventional (non-lithium bearing) aluminum alloys are (1) conversion of water to steam and (2) the chemical reaction of molten aluminum and water. The addition of lithium to the aluminum alloy produces a third, even more acute explosive force, the exothermic reaction of water and the molten aluminum-lithium "bleed-out" or "run-out" producing hydrogen gas. Any time the molten Al—Li alloy comes into contact with water, the reaction will occur. Even when casting with minimum water levels in the casting pit, the water comes into contact with the molten metal during a "bleed-out" or "run-out". This cannot be avoided, only reduced, since both components (water and molten metal) of the exothermic reaction will be present in the casting pit. Reducing the amount of water-to-aluminum contact will eliminate the first two explosive conditions, but the presence of lithium in the aluminum alloy will result in hydrogen evolution. If hydrogen gas concentrations are allowed to reach a critical mass and/or volume in the casting pit, explosions are likely to occur. The volume concentration of hydrogen gas required for triggering an explosion has been researched to be at a threshold level of 5% of volume of the total volume of the mixture of gases in a unit space. U.S. Pat. No. 4,188,884 describes making an underwater torpedo warhead, and recites page 4, column 2, line 33 referring to the drawings that a filler 32 of a material which is highly reactive with water, such as lithium is added. At column 1, line 25 of this same patent it is stated that large amounts of hydrogen gas are released by this reaction with water, producing a gas bubble with explosive suddenness.

U.S. Pat. No. 5,212,343 describes making an explosive reaction by mixing water with a number of elements and combinations, including Al and Li to produce large volumes of hydrogen containing gas. On page 7, column 3, it states "the reactive mixture is chosen that, upon reaction and contact with water, a large volume of hydrogen is produced from a relatively small volume of reactive mixture." Same paragraph, lines 39 and 40 identify aluminum and lithium. On page 8, column 5, lines 21-23 show aluminum in combination with lithium. On page 11 of this same patent, column 11, lines 28-30 refer to a hydrogen gas explosion.

In another method of conducting DC casting, patents have been issued related to casting Al-LI alloys using an ingot coolant other than water to provide ingot cooling without the water-lithium reaction from a 'bleed-out" or "run-out". U.S. Pat. No. 4,593,745 describes using a halogenated hydrocarbon or halogenated alcohol as ingot coolant. U.S. Pat. Nos. 4,610,295; 4,709,740; and 4,724,887 describe the use of ethylene glycol as the ingot coolant. For this to work, the halogenated hydrocarbon (typically ethylene glycol) must be free of water and water vapor. This is a solution to the explosion hazard, but introduces strong fire hazard and is costly to implement and maintain. A fire suppression system will be required within the casting pit to contain potential glycol fires. To implement a glycol based ingot coolant system including a glycol handling system, a thermal oxidizer to de-hydrate the glycol, and the casting pit fire protection system generally costs on the order of $5 to $8 million dollars (in today's dollars). Casting with 100% glycol as a coolant also brings in another issue. The cooling capability of glycol or other halogenated hydrocarbons is different than that for water, and different casting practices as well as casting tooling are required to utilize this type of technology. Another disadvantage affiliated with using glycol as a straight coolant is that because glycol has a lower heat conductivity and surface heat transfer coefficient than water, the microstructure of the metal cast with 100% glycol as a coolant has coarser undesirable metallurgical constituents and exhibits higher amount of centerline shrinkage porosity in the cast product. Absence of finer microstructure and simultaneous presence of higher concentration of shrinkage porosity has a deleterious effect on the properties of the end products manufactured from such initial stock.

In yet another example of an attempt to reduce the explosion hazard in the casting of Al—Li alloys, U.S. Pat. No. 4,237,961, suggests removing water from the ingot during DC casting. In European Patent No. 0-183-563, a device is described for collecting the "break-out" or "run-out" molten metal during direct chill casting of aluminum alloys. Collecting the "break-out" or "run-out" molten metal would concentrate this mass of molten metal. This teaching cannot be used for Al—Li casting since it would create an artificial explosion condition where removal of the water would result in a pooling of the water as it is being collected for removal. During a "bleed-out" or "run-out" of the molten metal, the "bleed-out" material would also be concentrated in the pooled water area. As taught in U.S. Pat. No. 5,212,343, this would be a preferred way to create a reactive water/Al—Li explosion.

Thus, numerous solutions have been proposed in the prior art for diminishing or minimizing the potential for explosions in the casting of Al—Li alloys. While each of these proposed solutions has provided an additional safeguard in such operations, none has proven to be entirely safe or commercially cost effective.

Thus, there remains a need for safer, less maintenance prone and more cost effective apparatus and processes for casting Al—Li alloys that will simultaneously produce a higher quality of the cast product.

DETAILED DESCRIPTION

Figure 1:
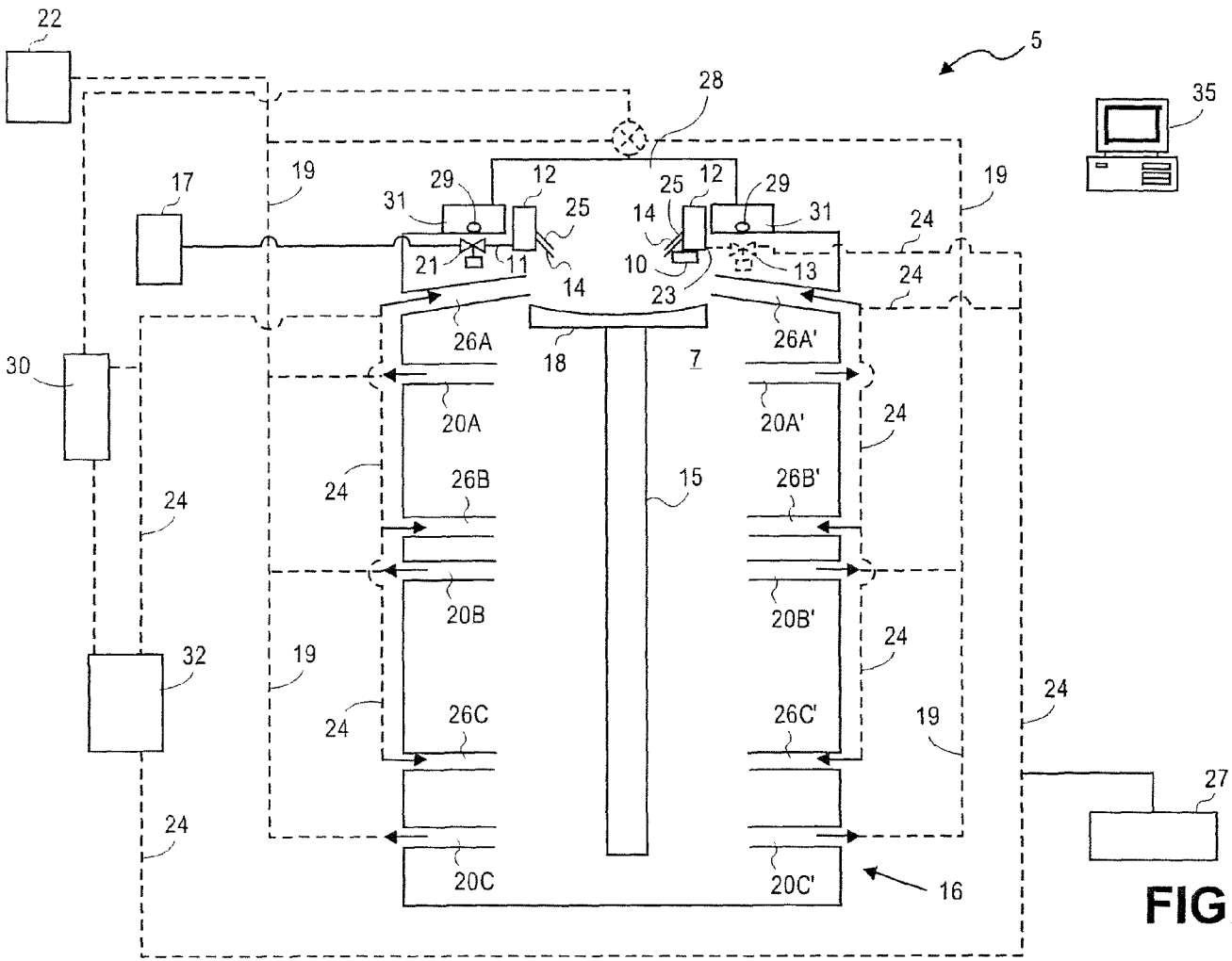
FIG. 1 is a simplified cross sectional view of one embodiment of a direct chill casting system.

According to one embodiment, exhaust ports are located around the interior perimeter of a direct chill casting pit, at various locations from just below the top of the pit to the pit bottom to rapidly remove water vapor or steam from the casting pit. Inert gas is simultaneously or subsequently introduced into the casting pit interior space to eliminate the coalition of hydrogen gas into a critical mass. According to one embodiment described herein, there is provided a modified mold for direct chill casting of Al—Li alloys that allows for the continuous or serial introduction of an inert gas into the coolant stream during casting while allowing for stoppage of the coolant flow and introduction of inert gas into the ingot solidification zone in the event of a "bleed out" or "run out".

An apparatus and method for casting Al—Li alloys is described. A concern with prior art teachings is that water and the Al—Li molten metal "bleed-out" or "run-out" materials come together and release hydrogen during an exothermic reaction. Even with sloped pit bottoms, minimum water levels, etc., the water and "bleed-out" or "run-out" molten metal may still come into intimate contact, enabling the reaction to occur. Casting without water, using another liquid such as those described in prior art patents affects castability, quality of the cast product, is costly to implement and maintain, as well as poses environmental concerns and fire hazards.

The instantly described apparatus and method improve the safety of DC casting of Al—Li alloys by minimizing or eliminating ingredients that must be present for an explosion to occur. It is understood that water (or water vapor or steam) in the presence of the molten Al—Li alloy will produce hydrogen gas. A representative chemical reaction equation is believed to be:

$$2LiAl+8H_2O \rightarrow 2LiOH+2Al(OH)_3+4H_2(g).$$

Hydrogen gas has a density significantly less than a density of air. Hydrogen gas that evolves during the chemical reaction, being lighter than air, tends to gravitate upward, toward the top of a cast pit, just below the casting mold and mold support structures at the top of the casting pit. This typically enclosed area allows the hydrogen gas to collect and become concentrated enough to create an explosive atmosphere. Heat, a spark, or other ignition source can trigger the explosion of the hydrogen 'plume' of the as-concentrated gas.

It is understood that the molten "bleed-out" or "run-out" material when combined with the intermediate casting product cooling water that is used in a DC process (as practiced by those skilled in the art of aluminum ingot casting) will create steam and/or water vapor. The steam and/or water vapor are accelerants for the reaction that produces the hydrogen gas. Removal of this steam and/or water vapor by a steam removal system will remove the ability of the water to combine with Al-LI creating Li—OH, and the expulsion of $H_2$. The instantly described apparatus and method minimizes the potential for the presence of steam and/or water vapor in the casting pit by, in one embodiment, placing exhaust ports about the inner periphery of the casting pit, and rapidly activating the vents upon the detection of an occurrence of a "bleed out".

According to one embodiment, the exhaust ports are located in several areas within the casting pit, e.g., from about 0.3 meters to about 0.5 meters below the casting mold, in an intermediate area from about 1.5 meters to about 2.0 meters from the casting mold, and at the bottom of the cast pit. For reference, and as shown in the accompanying drawings described in greater detail below, a casting mold is typically placed at a top of a casting pit, from floor level to as much as one meter above floor level. The horizontal and vertical areas around the casting mold below the mold table are generally closed-in with a pit skirt and a Lexan glass encasement except for the provision to bring in and ventilate outside air for dilution purpose, such that the gases contained within the pit are introduced and exhausted according to a prescribed manner.

In another embodiment, an inert gas is introduced into the casting pit interior space to minimize or eliminate the coalition of hydrogen gas into a critical mass. In this case, the inert gas is a gas that has a density less than a density of air and that will tend to occupy the same space just below the top of the casting pit that hydrogen gas would typically inhabit. Helium gas is one such example of suitable inert gas with a density less than a density of air.

The use of argon has been described in numerous technical reports as a cover gas for protecting Al—Li alloys from ambient atmosphere to prevent their reaction with air. Even though argon is completely inert, it has a density greater than a density of air and will not provide the inerting of the casting pit upper interior unless a strong upward draft is maintained. Compared to air as a reference (1.3 grams/liter), argon has density on the order of 1.8 grams/liter and would tend to settle to the bottom of a cast pit, providing no desirable hydrogen displacement protection within the critical top area of the casting pit. Helium, on the other hand, is nonflammable and has a low density of 0.2 grams per liter and will not support combustion. By exchanging air for a lower density of inert gas inside a casting pit, the dangerous atmosphere in the casting pit may be diluted to a level where an explosion cannot be supported. Also, while this exchange is occurring, water vapor and steam are also removed from the casting pit. In one embodiment, during steady state casting and when non-emergency condition pertaining to a 'bleed-out' is not being experienced, the water vapor and steam are removed from the inert gas in an external process, while the 'clean' inert gas can be re-circulated back through the casting pit.

It is to be noted that those skilled in the art of melting and direct chill casting of aluminum alloys except the melting and casting of aluminum-lithium alloys may be tempted to use nitrogen gas in place of helium because of the general industrial knowledge that nitrogen is also an 'inert' gas. However, for the reason of maintaining process safety, it is mentioned herein that nitrogen is really not an inert gas when it comes to interacting with liquid aluminum-lithium alloys. Nitrogen does react with the alloy and produces ammonia which in turns reacts with water and brings in additional reactions of dangerous consequences, and hence its use should be completely avoided. The same holds true for another presumably inert gas carbon di oxide. Its use should be avoided in any application where there is a finite chance of molten aluminum lithium alloy to get in touch with carbon dioxide.

A significant benefit obtained through the use of an inert gas that is lighter than air is that the residual gases will not settle into the casting pit, resulting in an unsafe environment in the pit itself. There have been numerous instances of heavier than air gases residing in confined spaces resulting in death from asphyxiation. It would be expected that the air within the casting pit will be monitored for confined space entry, but no process gas related issues are created.

Referring now to the accompanying drawings, FIG. 1 shows a cross-section of an embodiment of a DC casting system. DC system 5 includes casting pit 16 that is typically formed into the ground. Disposed within casting pit 16 is casting cylinder 15 that may be raised and lowered, for example, with a hydraulic power unit (not shown). Attached to a superior or top portion of casting cylinder 15 is platen 18 that is raised and lowered with casting cylinder 15. Above or superior to platen 18 in this view is stationary casting mold 12. Casting mold 12 has an open top and bottom as viewed and a body that defines a mold cavity (a cavity therethrough) and that includes a reservoir therein for a coolant. In one embodiment, coolant is introduced to the reservoir in mold 12 through coolant port 11. Coolant port 11 is connected through a conduit (e.g., stainless steel conduit) to coolant source 17 containing a suitable coolant such as water. A pump may be in fluid communication with the coolant and assist in a movement of the coolant to coolant port 17 and the reservoir in mold 12. In one embodiment, valve 21 is disposed between the coolant source and coolant port 11 to control the flow of coolant into the reservoir. A flow meter may also be present in the conduit to monitor a flow rate of coolant to the reservoir. Valve 21 may be controlled by a controller (controller 35) and such controller can also monitor a flow rate of coolant through the conduit.

Molten metal is introduced into casting mold 12 and is cooled by the cooler temperature of the casting mold and through the introduction of a coolant through coolant feeds 14 associated with casting mold 12 around a base or bottom of casting mold 12 that impinges on the intermediate casting product after it emerges from the mold cavity (emerges below the casting mold). In one embodiment, the reservoir in the casting mold is in fluid communication with coolant feeds 14. Coolant (e.g., water) from coolant feeds 14 flows onto a surface or periphery of an emerging intermediate casting product (e.g., an ingot) and provides a direct chill and solidification of the metal. Surrounding casting mold 12 is casting table 31. As shown in FIG. 1, in one embodiment, gasket or seal 29 fabricated from, for example, a high temperature resistant silica material is located between the structure of mold 12 and table 31. Gasket 29 inhibits steam or any other atmosphere from below mold table 31 to reach above the mold table and thereby inhibits the pollution of the air in which casting crewmen operate and breathe.

In the embodiment shown in FIG. 1, system 5 includes molten metal detector 10 positioned just below mold 12 to detect a bleed out or run-out. Molten metal detector 10 may be, for example, an infrared detector of the type described in U.S. Pat. No. 6,279,645, a "break out detector" as described in U.S. Pat. No. 7,296,613 or any other suitable device that can detect the presence of a "bleed out".

In the embodiment shown in FIG. 1, system 5 also includes exhaust system 19. In one embodiment, exhaust system 19 includes, in this embodiment, exhaust ports 20A, 20A', 20B, 20B', 20C and 20C' positioned in casting pit 16. The exhaust ports are positioned to maximize the removal of generated gases including ignition sources (e.g., $H_2$(g) and reactants (e.g., water vapor or steam)) from the inner cavity of the casting pit. In one embodiment, exhaust ports 20A, 20A' are positioned about 0.3 meters to about 0.5 meters below mold 12; exhaust ports 20B, 20B' are positioned about 1.5 meters to about 2.0 meters below the mold 12; and exhaust ports 20C, 20C' are positioned at a base of casting pit 16 where bleed out metal is caught and contained. The exhaust ports are shown in pairs at each level. It is appreciated that, in an embodiment where there are arrays of exhaust ports at different levels such as in FIG. 1, there may be more than two exhaust ports at each level. For example, in another embodiment, there may be three or four exhaust ports at each level. In another embodiment, there may be less than two (e.g., one at each level). Exhaust system 19 also includes remote exhaust vent 22 that is remote from casting mold 12 (e.g., about 20 to 30 meters away from mold 12) to allow exit of exhausted gases from the system. Exhaust ports 20A, 20A', 20B, 20B', 20C, 20C' are connected to exhaust vent 22 through ducting (e.g., galvanized steel or stainless steel ducting). In one embodiment, exhaust system 19 further includes an array of exhaust fans to direct exhaust gases to exhaust vent 22.

FIG. 1 further shows gas introduction system 24 including, in this embodiment, inert gas introduction ports (e.g., inert gas introduction ports 26A, 26A', 26B, 26B', 26C and 26C') disposed around the casting pit and connected to an inert gas source or sources 27. In one embodiment, concurrent to positions of each of ports 26B and 26B', and 26C and 26C', there are positioned excess air introduction ports to assure additional in-transit dilution of the evolved hydrogen gas. The positioning of gas introduction ports is selected to provide a flood of inert gas to immediately replace the gases and steam within the pit, via a gas introduction system 24 that introduces inert gas as and when needed (especially upon the detection of the bleed-out) through inert gas introduction ports 26 into casting pit 16 within a predetermined time (e.g., about a maximum of 30 seconds) of the detection of a "bleed out" condition. FIG. 1 shows gas introduction ports 26A and 26A' positioned near a top portion of casting pit 16; gas introduction ports 26B and 26B' positioned at an intermediate portion of casting pit 16; and gas introduction ports 26C and 26C' positioned at a bottom portion of casting pit 16. Pressure regulators or valves may be associated with each gas introduction port to control the introduction of an inert gas. The gas introduction ports are shown in pairs at each level. It is appreciated that, in an embodiment, where there are arrays of gas introduction ports at each level, there may be more than two gas introduction ports at each level. For example, in another embodiment, there may be three or four gas introduction ports at each level. In another embodiment, there may be less than two (e.g., one) at each level.

As shown in FIG. 1, in one embodiment, the inert gas introduced through gas introduction ports 26A and 26A' at top 14 of casting pit 16 impinges on the solidified, semi-solid and liquid aluminum lithium alloy below mold 12, and inert gas flow rates in this area are, in one embodiment, at least substantially equal to a volumetric flow rate of a coolant prior to detecting the presence of a "bleed out" or a "run out". In embodiments where there are gas introduction ports at different levels of a casting pit, flow rates through such gas introduction ports may be the same as a flow rate through the gas introduction ports at top 14 of casting pit 16 or may be different (e.g., less than a flow rate through the gas introduction ports at top 14 of casting pit 16).

In another embodiment, gas introduction system 24 includes a conduit to auxiliary gas introduction port 23 in mold 12 so that an inert gas can replace or be added with the coolant flowing through the mold (e.g., by discharging inert gas with coolant through coolant feeds) or separately flow through the mold (e.g., in the embodiment shown, a body of mold 12 has a reservoir for coolant in fluid communication with coolant source 17, coolant port 11, and coolant feeds 14 and a separate manifold for inert gas in fluid communication inert gas source 27, auxiliary gas introduction port 23 and with one or more inert gas feeds 25 into the casting pit). Representatively, valve 13 is disposed in the conduit to control or modulate a flow of inert gas into mold 12 through auxiliary gas introduction port 23. In one embodiment, valve 13 is closed or partially closed under non-bleed-out or non-run-out conditions and opened in response to a bleed-out or run-out. In embodiments where there are gas introduction ports at different levels of a casting pit, flow rates through such gas introduction ports may be the same as a flow rate through the gas introduction ports at top 14 of casting pit 16 or may be different (e.g., less than a flow rate through the gas introduction ports at top 14 of casting pit 16). Valve 13 may be controlled by a controller (controller 35) and a pressure in the conduit to auxiliary gas introduction port 23 may be monitored by the controller through, for example, a pressure gauge in the conduit.

As noted above, one suitable inert gas to introduce through the gas introduction ports is helium. Helium has a density less than a density of air, will not react with aluminum or lithium to produce a reactive product and has a relatively high thermal conductivity (0.15 $W \cdot m^{-1} \cdot K^{-1}$). Where inert gas is introduced to replace a flow of coolant through mold 12, such as in the case of a bleed-out or run-out, in one embodiment, an inert gas such as helium having a relatively high thermal conductivity is introduced to inhibit deformation of the mold by molten metal. In another embodiment, a mixture of inert gas may be introduced. Representatively, a mixture of inert gas includes a helium gas. In one embodiment, a mixture of inert gas includes a helium gas and an argon gas that includes at least about 20 percent of the helium gas. In another embodiment, a helium/argon mixture includes at least about 60 percent of a helium gas. In a further embodiment, a helium/argon mixture includes at least about 80 percent of a helium gas and correspondingly at most about 20 percent of an argon gas.

The replacement inert gas introduced through the gas introduction ports is removed from casting pit 16 by an upper exhaust system 28 which, in one embodiment, is kept activated at lower volume on continuous basis but the volume flow rate is enhanced immediately upon detection of a "bleed out" and directs inert gas removed from the casting pit to the exhaust vent 22. In one embodiment, prior to the detection of bleed out, the atmosphere in the upper portion of the pit may be continuously circulated through an atmosphere purification system consisting of moisture stripping columns and steam desiccants thus keeping the atmosphere in the upper region of the pit reasonably inert. The removed gas while being circulated is passed through the desiccant and any water vapor is removed to purify the upper pit atmosphere containing inert gas. The purified inert gas may then be re-circulated to inert gas injection system 24 via a suitable pump 32. When this embodiment is employed, inert gas curtains are maintained, between ports 20A and 26A and similarly between ports 20A' and 26A' to minimize the escape of the precious inert gas of the upper region of the casting pit through the pit ventilation and exhaust system.

The number and exact location of exhaust ports 20A, 20A', 20B, 20B', 20C, 20C' and inert gas introduction ports 26A, 26A', 26B, 26B', 26C, 26C' will be a function of the size and configuration of the particular casting pit being operated and these are calculated by the skilled artisan practicing DC casting in association with those expert at recirculation of air and gases. It is most desirable to provide the three sets (e.g., three pairs) of exhaust ports and inert gas introduction ports as shown FIG. 1. Depending on the nature and the weight of the product being cast, a somewhat less complicated and less expensive but equally effective apparatus can be obtained using a single array of exhaust ports and inert gas introduction ports about the periphery of the top of casting pit 16.

In one embodiment, each of a movement of platen 18/casting cylinder 15, a molten metal supply inlet to mold 12 and a water inlet to the mold are controlled by controller 35. Molten metal detector 10 is also connected to controller 35. Controller 35 contains machine-readable program instructions as a form of non-transitory tangible media. In response to a signal from molten metal detector 10 to controller 35 of an Al—Li molten metal "bleed-out" or "run-out", the machine-readable instructions cause movement of platen 18 and molten metal inlet supply (not shown) to stop, coolant flow (not shown) into mold 12 to stop and/or be diverted, and higher volume exhaust system 19 to be activated simultaneously or within about 15 seconds and in another embodiment, within about 10 seconds, to divert the water vapor containing exhaust gases and/or water vapor away from the casting pit via exhaust ports 20A, 20A', 20B, 20B', 20C and 20C' to exhaust vent 22. At the same time or shortly thereafter (e.g., within about 10 seconds to within about 30 seconds), the machine-readable instructions further activate gas introduction system and an inert gas having a density less than a density of air, such as helium, is introduced through gas introduction ports 26A, 26A', 26B, 26B', 26C and 26C'.

The process and apparatus described herein provide a unique method to adequately contain Al—Li "bleed-outs" or "run-outs" such that a commercial process can be operated successfully without utilization of extraneous process methods, such as casting using a liquid like ethylene glycol that render the process not optimal for cast metal quality, a process less stable for casting, and at the same time a process which is uneconomical and flammable. As anyone skilled in the art of ingot casting will understand, it must be stated that in any DC process, "bleed-outs" and "run-outs" will occur. The incidence will generally be very low, but during the normal operation of mechanical equipment, something will occur outside the proper operating range and the process will not perform as expected. The implementation of the described apparatus and process and use of this apparatus will minimize water-to-molten metal hydrogen explosions from "bleed-outs" or "run-outs" while casting Al—Li alloys that result in casualties and property damage.

As noted above, as an intermediate casting product emerges from a casting mold cavity, coolant from the coolant feeds around the casting mold impinges about the periphery of the intermediate casting product corresponding to a point just below where coolant exits the coolant feeds 14. The latter location is commonly referred to as the solidification zone. Under these standard conditions, a mixture of water, and air is produced in casting pit about the periphery of the intermediate casting product, and into which freshly produced water vapor is continuously introduced as the casting operation continues.

Figure 2:
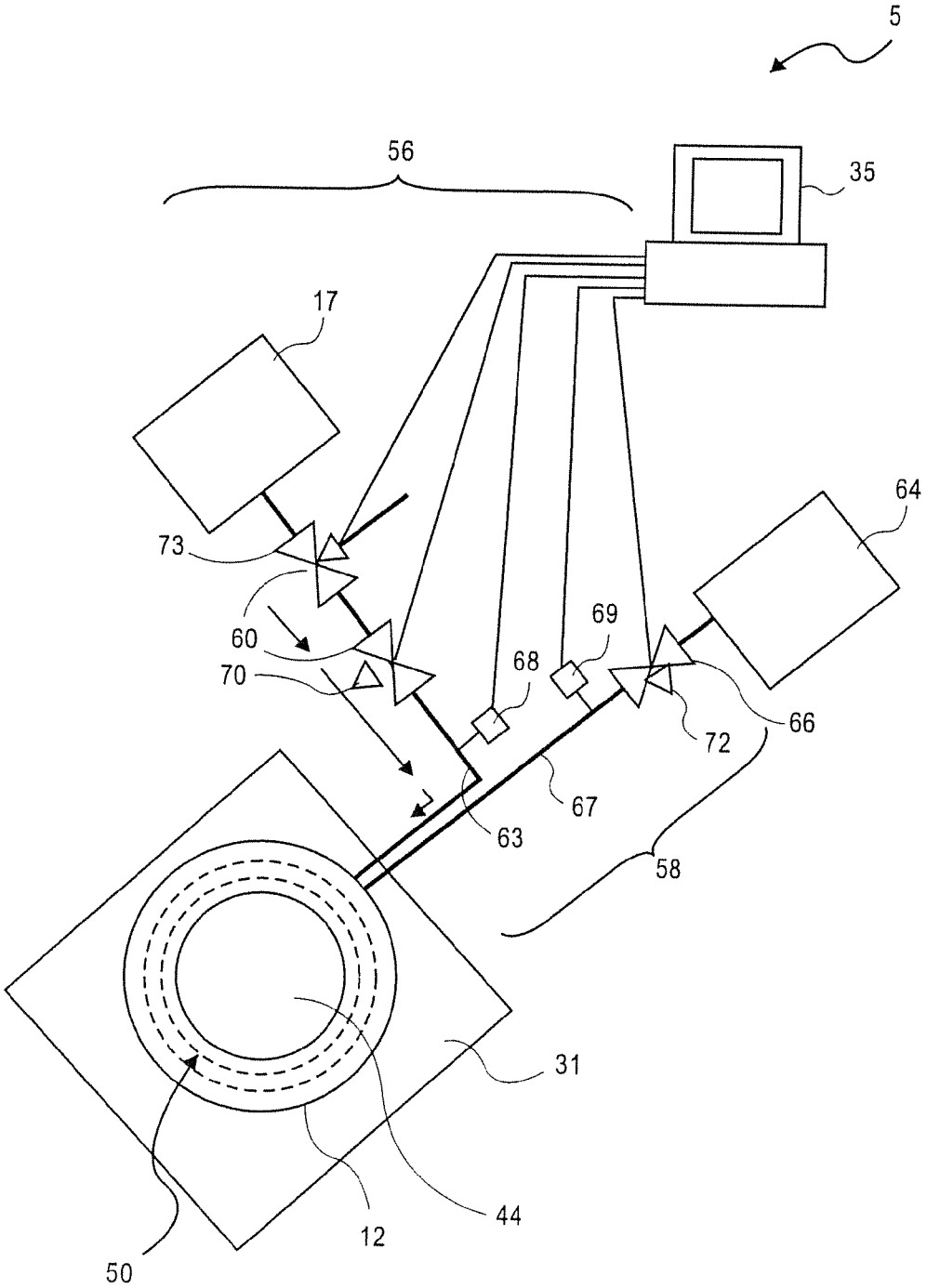
FIG. 2 is a top schematic view of the casting system of FIG. 1 showing a valve configuration for a coolant feed system under normal operating conditions.

Shown in FIG. 2 is a schematic top plan view of system 5 showing casting mold 12 and casting table 31. In this embodiment, system 5 includes a coolant feed system that is placed in the coolant feed, either between a reservoir in casting mold 12 (reservoir 50 in FIG. 2) and the coolant feeds (coolant feeds 14, FIG. 1) or upstream of reservoir 50. Coolant feed system 56, in this embodiment, replaces coolant port 11, valve 21 and the associated conduit between coolant port 11 and coolant source 17. As shown in FIG. 2, in the illustrated embodiment, coolant feed system 56 is upstream of reservoir 50. Mold 12 (illustrated in this embodiment as a round mold) surrounds metal 44 (e.g., molten metal introduced into mold 12). Also as seen in FIG. 2, coolant feed system 56 includes valve system 58 connected to conduit 63 or conduit 67 that each feeds reservoir 50. Suitable material for conduit 63 and conduit 67 and the other conduits and valves discussed herein includes, but is not limited to, stainless steel (e.g., a stainless steel tubular conduit). Valve system 58 includes first valve 60 associated with conduit 63. First valve 60 allows for the introduction of a coolant (generally water) from coolant source 17 through valve 60 and conduit 63. Valve system 58 also includes second valve 66 associated with conduit 67. In one embodiment, second valve 66 allows for the introduction of an inert fluid from inert fluid source 64 through second valve 66 and conduit 67. Conduit 63 and conduit 67 connect coolant source 17 and inert fluid source 64, respectively, to reservoir 12.

An inert fluid for inert fluid source 64 is a liquid or gas that will not react with lithium or aluminum to produce a reactive (e.g., explosive) product and at the same time will not be combustible or support combustion. In one embodiment, an inert fluid is an inert gas. A suitable inert gas is a gas that has a density that is less than a density of air and will not react with lithium or aluminum to produce a reactive product. Another property of a suitable inert gas to be used in the subject embodiment is that the gas should have a higher thermal conductivity than ordinarily available in inert gases or in air and inert gas mixtures. An example of such suitable gas simultaneously meeting the aforesaid requirements is helium (He). Where inert gas is introduced to replace a flow of coolant through mold 12, such as in the case of a bleed-out or run-out, in one embodiment, an inert gas such as helium, having a relatively high thermal conductivity is introduced to inhibit deformation of the mold by molten metal. In another embodiment, a mixture of inert gases may be introduced. Representatively, a mixture of inert gases includes a helium gas. In one embodiment, a mixture of inert gases includes a helium gas and an argon gas may be used. According to one embodiment, a helium/argon mixture includes at least about 20 percent of the helium gas. According to another embodiment, a helium/argon mixture includes at least about 60 percent of the helium gas. In a further embodiment, a helium/argon mixture includes at least about 80 percent of a helium gas and correspondingly at most about 20 percent of an argon gas.

In FIG. 2, which represents normal casting conditions, first valve 60 is open and second valve 66 is closed. In this valve configuration, only coolant from coolant source 17 is admitted into conduit 63 and thus reservoir 12 while inert fluid from inert fluid source 64 is excluded therefrom. A position (e.g., fully opened, partially opened) of valve 60 may be selected to achieve a desired flow rate, measured by a flow rate monitor associated with valve 60 or separately positioned adjacent valve 60 (illustrated downstream of valve 60 as first flow rate monitor 68). According to one embodiment, where desired, second valve 66, can be partially opened so that inert fluid (e.g., an inert gas) from inert fluid source 64 may be mixed in reservoir 12 with coolant from coolant source 17 during normal casting conditions. A position of valve 66 may be selected to achieve a desired flow rate, measured by a flow rate monitor associated with valve 66 or separately positioned adjacent valve 66 (illustrated downstream of valve 66 as second flow rate monitor 69) (e.g., a pressure monitor for an inert fluid source).

In one embodiment, each of first valve 60, second valve 66, first flow rate monitor 68 and second flow rate monitor 69 is electrically and/or logically connected to controller 35. Controller 35 includes non-transitory machine-readable instructions that, when executed, cause one or both of first valve 60 and second valve 66 to be actuated. For example, under normal casting operations such as shown in FIG. 2, such machine-readable instructions cause first valve 60 to be open partially or fully and second valve 66 to be closed or partially open.

Figure 3:
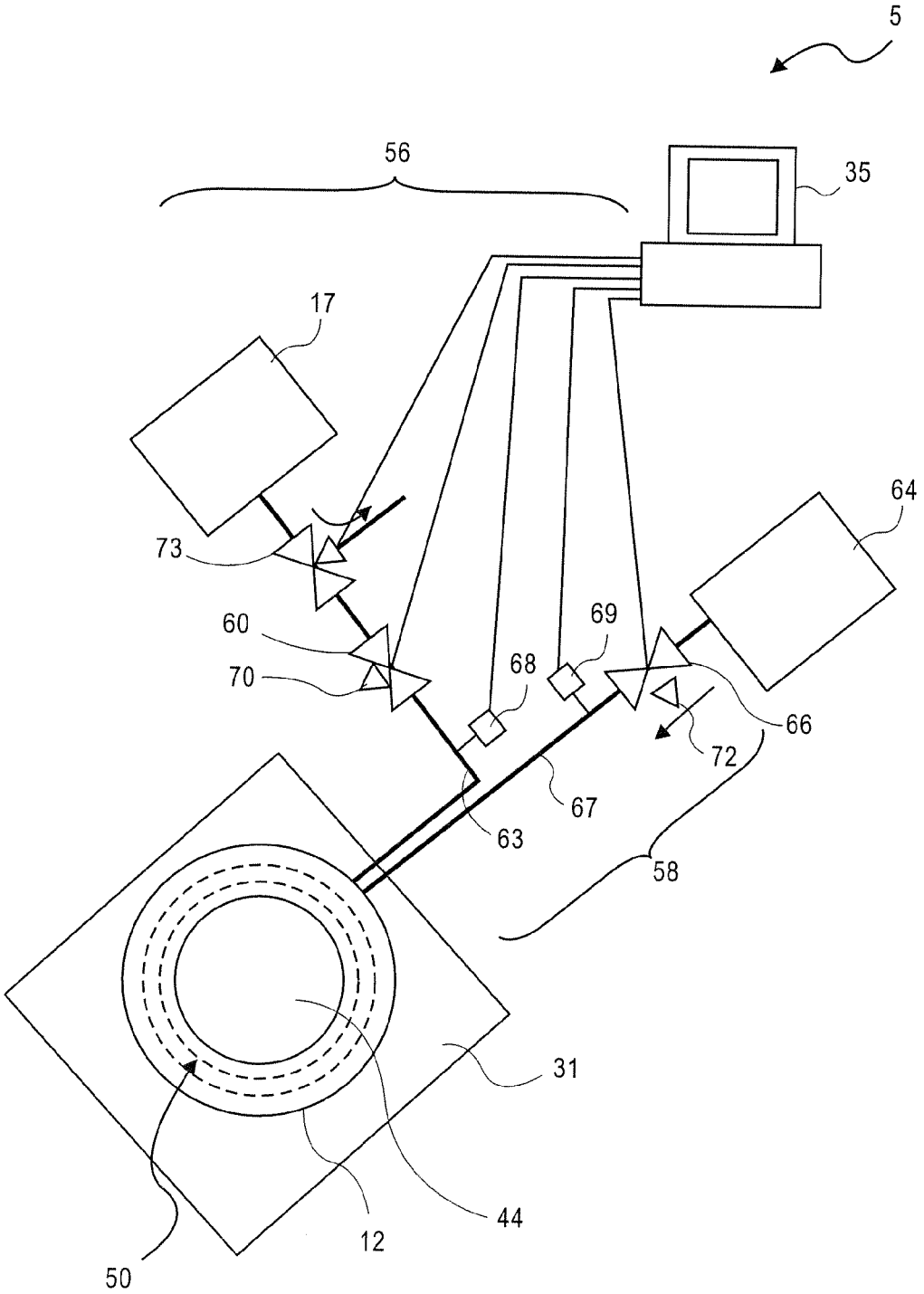
FIG. 3 is a top schematic view of the casting system of FIG. 1 showing a valve configuration for a coolant feed system upon detection of a bleed out.

Turning now to FIG. 3, this figure shows valve system 58 in a configuration upon an occurrence of a "bleed out" or "run "out". Under these circumstances, upon detection of a "bleed out" or "run out" by bleed out detection device 10 (see FIG. 1), first valve 60 is closed to stop the flow of coolant (e.g., water) from coolant source 17. At the same time or shortly thereafter, within 3 to 20 seconds, second valve 66 is opened to allow the admission of an inert fluid from inert fluid source 64, so that the only inert fluid is admitted into conduit 67. Where an inert fluid is an inert gas such as helium (He), under this condition, given the lower density of helium than air, water or water vapor, the area at the top of casting pit 16 and about mold 12 (see FIG. 1) is immediately flooded with inert gas thereby displacing any mixture of water and air and inhibiting the formation of hydrogen gas or contact of molten Al/Li alloy with coolant (e.g., water) in this area, thereby significantly reducing the possibility of an explosion due to the presence of these materials in this region. Velocities of between 1.0 ft/sec and about 6.5 ft/sec., preferably between about 1.5 ft/sec and about 3 ft/sec and most preferably about 2.5 ft/sec are used. In one embodiment where an inert fluid is an inert gas, inert gas source 64 may correspond to inert gas source or sources 27 that supply gas introduction system 24 described with reference to FIG. 1.

Also shown in FIGS. 2 and 3 are check valve 70 and check valve 72 associated with first valve 60 and second valve 66, respectively. Each check valve inhibits the flow of coolant and/or inert fluid (e.g., gas) backward into respective valves 60 and 66 upon the detection of a bleed out and a change in material flow into mold.

As shown schematically in FIGS. 2 and 3, in one embodiment, coolant supply line 63 is also equipped with by-pass valve 73 to allow for immediate diversion of the flow of coolant to an external "dump" prior to its entry into first valve 60, so that upon closure of first valve 60, water hammering or damage to the feed system or leakage through valve 60 is minimized. In one embodiment, the machine-readable instructions in controller 35 include instructions such that once a "bleed out" is detected by, for example, a signal to controller 35 from an infrared thermometer, the instructions cause by-pass valve 73 to be actuated to open to divert coolant flow; first valve 60 to be actuated sequentially to closed; and second valve 66 actuated to open to allow admission of an inert gas.

As noted above, one suitable inert gas is helium. Helium has a relatively high heat conductivity that allows for continuous extraction of heat from a casting mold and from solidification zone once coolant flow is halted. This continuous heat extraction serves to cool the ingot/billet being cast thereby reducing the possibility of any additional "bleed outs" or "run outs" occurring due to residual heat in the head of the ingot/billet. Simultaneously the mold is protected from excessive heating thereby reducing the potential for damage to the mold. As a comparison, thermal conductivities for helium, water and glycol are as follows: He; 0.1513 $W \cdot m^{-1} \cdot K^{-1}$; $H_2O$; 0.609 $W \cdot m^{-1} \cdot K^{-1}$; and Ethylene Glycol; 0.258 W—$m^{-1} \cdot K^{-1}$.

Although the thermal conductivity of helium, and the gas mixtures described above, are lower than those of water or glycol, when these gases impinge upon an intermediate casting product such as an ingot or billet at or near a solidification zone, no "steam curtain" is produced that might otherwise reduce the surface heat transfer coefficient and thereby the effective thermal conductivity of the coolant. Thus, a single inert gas or a gas mixture exhibits an effective thermal conductivity much closer to that of water or glycol than might first be anticipated considering only their directly relative thermal conductivities As will be apparent to the skilled artisan, while FIGS. 2 and 3 depict an intermediate casting product of a billet or round section of cast metal being formed, the apparatus and method described is equally applicable to the casting of rectangular ingot or other shapes or forms.

Figure 4:
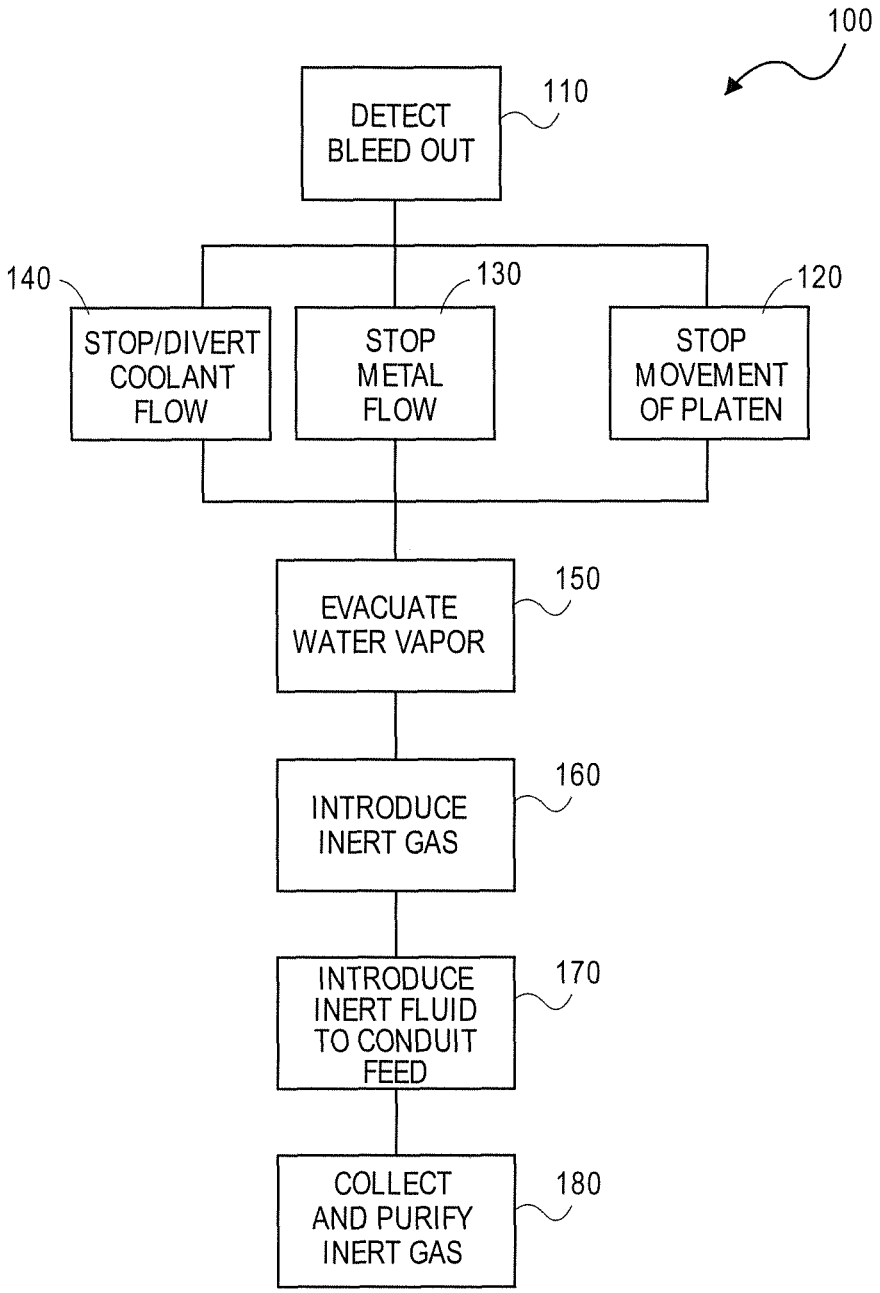
FIG. 4 is a process flow diagram of an embodiment of a process.

FIG. 4 presents a flow chart of a method of operation of system 5, particularly in the event of a bleed out. The method will be described in terms of an automated process where a controller, such as controller 35 in FIGS. 1-3 controls system 5 through machine-readable instructions (e.g., a computer program) stored in the controller or accessible by the controller. In one embodiment, controller 35 contains machine-readable instructions that when executed control an operation of system including an operation on a detection of a bleed out. As noted above, in one embodiment, controller 35 controls each of a movement of platen 18/casting cylinder 15, a molten metal supply inlet to mold 12 and a coolant/inert fluid inlet to the mold. Molten metal detector 10 is also connected to controller 35. Controller 35 contains machine-readable program instructions as a form of non-transitory tangible media. Referring to FIG. 4 and method 100, first an Al—Li molten metal "bleed out" or "run out" is detected by molten metal detector 10 (block 110). In response to a signal from molten metal detector 10 to controller 35 of an Al—Li molten metal "bleed-out" or "run-out", controller 35 directs movement of platen 18 and molten metal inlet supply (not shown) to stop (blocks 120, 130), and coolant flow into coolant feeds 14 to stop (e.g., stop coolant flow to conduit feed 52 by actuation of valve 60 to closed (FIG. 3)) (block 140). Simultaneous with the noted operations or within about 15 seconds and in another embodiment, within about 10 seconds, higher volume exhaust system 19 (FIG. 1) is activated by execution of machine-readable instructions by controller 35 to divert the water vapor containing exhaust gases and/or water vapor away from the casting pit via exhaust ports 20A, 20A', 20B, 20B', 20C and 20C' to exhaust vent 22 (block 150). At the same time or shortly thereafter (e.g., within about 10 seconds to within about 30 seconds), the execution of the machine-readable instructions by controller 35 activates gas introduction system 24 (FIG. 1). Activation of gas introduction system introduces an inert gas having a density less than a density of air, such as helium, through gas introduction ports 26A, 26A', 26B, 26B', 26C and 26C' into the casting pit (block 160). At the same time or shortly thereafter, in one embodiment, the execution of the machine-readable instructions actuate valve 66 to open (FIG. 3) to introduce an inert fluid (e.g., helium gas or a mixture of inert gas) into coolant feeds 14 (e.g., actuation of valve 66 to introduce an inert fluid to mold 12 through conduit feed 52) (block 170). The introduced inert gas (e.g., inert gas introduced through gas introduction system 24 (FIG. 1) and/or inert gas introduced into coolant feeds 14 from inert fluid source 64 (FIG. 3)) is subsequently collected via the exhaust gas system and may then be purified (block 180). As the bleed out mediation continues, execution of the machine-readable instructions by controller 35 further controls the collection and purification of inert gas by, for example, controlling pump 32 (FIG. 1).

A significant benefit obtained through the use of lighter-than-air inert fluid is that the residual gasses will not settle into the casting pit, resulting in an unsafe environment in the pit itself. There have been numerous instances of heavier than air gasses residing in confined spaces resulting in death from asphyxiation. Even though the cast pit is generally considered a confined space, no additional external air will be required to supplement the air within the casting pit. It would be expected that the air within the cast pit will be monitored for confined space entry, but no process gas related issues are created.

This process describes a unique method to adequately contain Al—Li "bleed-outs" or "run-outs" such that a commercial process can be operated successfully without utilization of extraneous process methods, such as casting using a liquid like ethylene glycol that render the process uneconomical and potentially flammable. As anyone skilled in the art of ingot casting will understand, it must be stated that in any direct chill process, "bleed-outs" and "run-outs" will occur. The incidence will generally be very low, but during the normal operation of mechanical equipment, something will occur outside the proper operating range and the process will not perform as expected. The implementation of this process and the utilization of the apparatus described herein will minimize water-to-molten metal hydrogen explosions from "bleed-outs" or "run-outs" while casting Al—Li alloys that result in casualties and property damage.

In one embodiment, an Al—Li alloy manufactured using a direct chill casting pit as described contains about 0.1 percent to about six percent lithium and, in another embodiment, about 0.1 percent to about three percent lithium. In one embodiment, an Al—Li alloy manufactured using a charging apparatus as described contains lithium in the range of 0.1 percent to 6.0 percent, copper in the range of 0.1 percent to 4.5 percent, and magnesium in the range of 0.1 percent to 6 percent with silver, titanium, zirconium as minor additives along with traces of alkali and alkaline earth metals with the balance aluminum. Representative Al—Li alloys include but are not limited to Alloy 2090 (copper 2.7%, lithium 2.2%, silver 0.4% and zirconium 0.12%); Alloy 2091 (copper 2.1%, lithium 2.09% and zirconium 0.1%); Alloy 8090 (lithium 2.45%, zirconium 0.12%, copper 1.3% and magnesium 0.95%); Alloy 2099 (copper 2.4-3.0%, lithium 1.6-2.0%, zinc 0.4-1.0%, magnesium 0.1-0.5%, manganese 0.1-0.5%, zirconium 0.05-0.12%, iron 0.07% maximum and silicon 0.05% maximum); Alloy 2195 (1% lithium, 4% copper, 0.4% silver and 0.4% magnesium); and Alloy 2199 (zinc 0.2-0.9%, magnesium 0.05-0.40%, manganese 0.1-0.5%, zirconium 0.05-0.12%, iron 0.07% maximum and silicon 0.07% maximum). A representative Al—Li alloy is an Al—Li alloy having properties to meet the requirements of 100,000 pounds per square inch ("psi") tensile strength and 80,000 psi yield strength.

Figure 5:
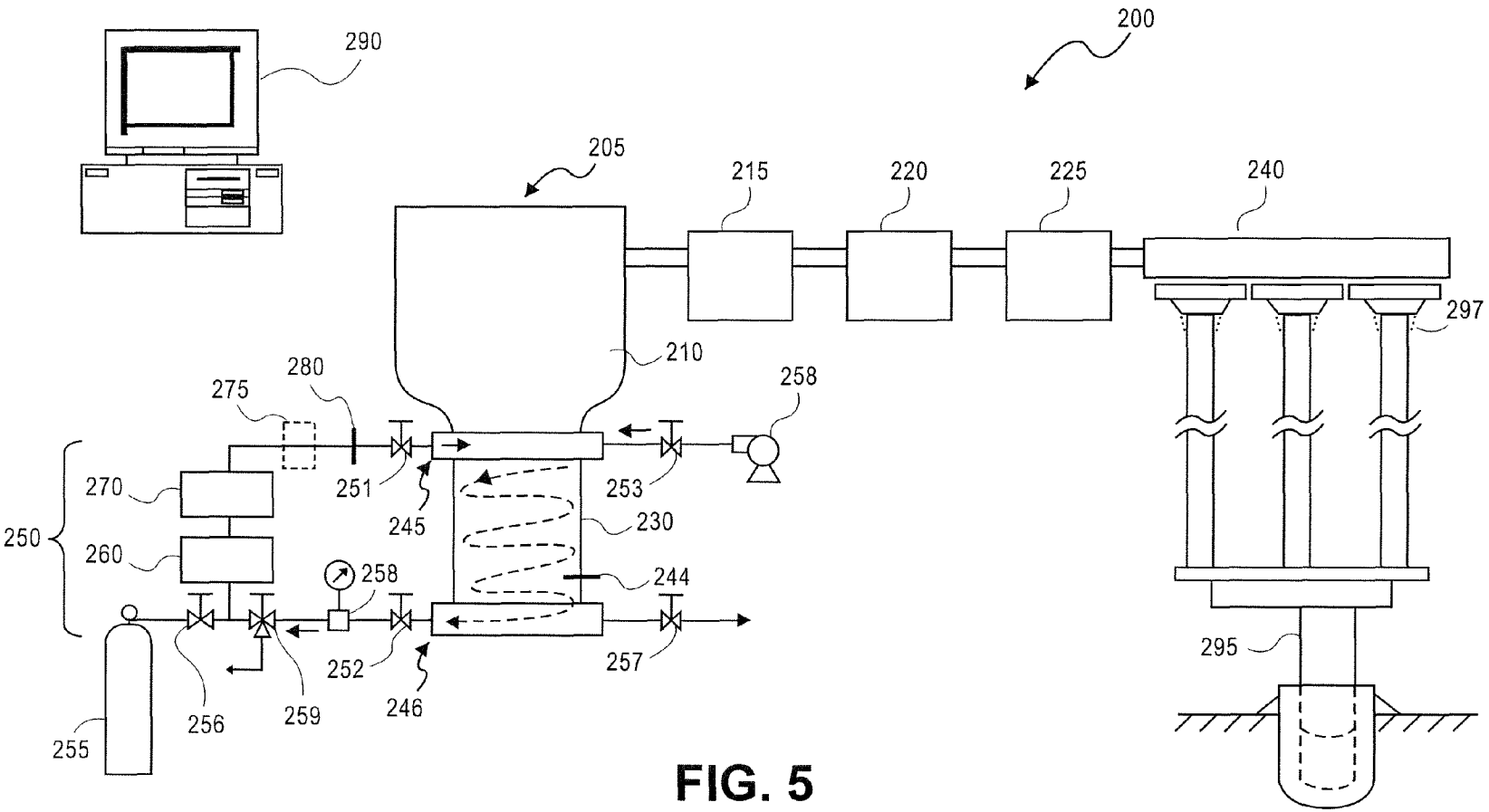
FIG. 5 is a schematic side view of a system operable to form an alloy melt and one or more intermediate casting products from an alloy melt.

FIG. 5 presents a side view of a schematic of a system for forming one or more intermediate casting products such as billets, slabs, ingots, blooms or other forms in a direct chill casting process. According to FIG. 5, system 200 includes induction furnace 205 including furnace vessel 210 and melt-containing vessel 230 around which an inductor coil is located. In one embodiment of making an Al—Li alloy, a solid charge of aluminum and lithium and any other metals for the desired alloy are introduced into a lower portion of furnace vessel 210 and into melt-containing vessel 230. Representatively, the aluminum metal may be introduced and melted initially prior to the introduction of lithium metal. Once the aluminum metal is melted, lithium metal is introduced. Other metals may be introduced before or with the initial introduction of aluminum or before, after or with the lithium metal. Such metals may be introduced with a charging apparatus. The metals are melted by induction heating (via the induction coil) and the melted metals are transferred through a conduit by, for example, gravity feed to first filter 215, through degasser 220, to second filter 225 and to intermediate casting product forming station 240.

Induction furnace 205 in system 200 includes an induction coil surrounding melt-containing vessel 230. In one embodiment, there is a gap between an outside surface of melt-containing vessel 230 and an inside surface of the induction coil. In one embodiment, an inert gas is circulated in the gap. The representation of induction furnace 205 in FIG. 5 shows gas circulating around a representatively cylindrical melt-containing vessel (e.g., around the entire outer surface of the vessel). FIG. 5 shows a gas circulation subsystem associated with system 200. In one embodiment, a gas, such as an inert gas (e.g., helium), is supplied from gas source 255 through, for example, a stainless steel tube. Various valves control the supply of the gas. When a gas is supplied from gas source 255, valve 256 adjacent gas source 255 is open as is valve 251 to allow gas to be introduce into feed port 245 and valve 252 to allow gas to be discharged from discharge port 246 into the circulation subsystem. In one embodiment, the gas is introduced into feed port 245 associated with induction furnace 205. The introduced gas circulates in the gap between melt-containing vessel 230 and the induction coil. The circulated gas then exits induction furnace 205 through discharge port 246. From discharge port 246, the gas is passed through in-line hydrogen analyzer 258. Hydrogen analyzer 258 measures an amount (e.g., a concentration) of hydrogen in the gas stream. If the amount exceeds, for example, 0.1 percent by volume, the gas is vented to the atmosphere through vent valve 259. The circulated gas from discharge port 246 is also passed through purifier 260. Purifier 260 is operable or configured to remove hydrogen and/or moisture from the inert gas. An example of a purifier to remove moisture is a dehumidifier. From purifier 260, the gas is exposed to heat exchanger 270. Heat exchanger 270 is configured to remove heat from the gas to regulate a gas temperature to, for example, below 120° F. Representatively, in circulating through the gap between the induction coil and the melt-containing vessel, a gas may pick up/retain heat and a temperature of the gas will rise. Heat exchanger 270 is configured to reduce the temperature of the gas and, in one embodiment, to return such temperature to a target temperature which is below 120° F. and, in one embodiment, is around room temperature. In one embodiment, in addition to exposing the gas to heat exchanger 270, the gas may be cooled by exposing the gas to refrigeration source 275. In this manner, the temperature of the gas may be reduced significantly prior to entering/re-entering induction furnace 205. As shown in FIG. 5, the gas circulation subsystem 250 includes temperature monitor 280 (e.g., a thermocouple) prior to feed port 245. Temperature monitor 280 is operable to measure a temperature of a gas being fed into feed port 245. The circulation of gas through the described stages of gas circulation subsystem 250 (e.g., hydrogen analyzer 258, purifier 260, heat exchanger 270 and refrigeration source 275) may be through a tube, e.g., a stainless steel tube, to which each described stage is connected. In addition, it is appreciated that the order of the described stages may vary.

In another embodiment, the gas circulated through the gap between the melt-containing vessel 230 and the induction coil is atmospheric air. Such an embodiment may be used with alloys that do not contain reactive elements as described above. Referring to FIG. 5, where atmospheric air is to be introduced into the gap, gas circulation subsystem 250 may be isolated to avoid contamination. Accordingly, in one embodiment, valves 251, 252 and 256 are closed. To allow the introduction of air into feed port 245, air feed valve 253 is opened. To allow discharge from discharge port 246, air discharge valve 257 is opened. Air feed valve 253 and air discharge valve 257 are closed when gas circulation subsystem 250 is used and a gas is supplied from gas source 255. With air feed valve 253 and air discharge valve 257 open, atmosphere air is supplied to the gap by blower 258 (e.g., a supply fan). Blower 258 creates an air flow that supplies air (e.g., through tubing) to feed valve 245 at a volume representatively on the order of 12,000 cfm. Air circulates through the gap and is discharged through discharge port 246 to the atmosphere.

As noted above, from induction furnace 205, a melted alloy flows through filter 215 and filter 225. Each filter is designed to filter impurities from the melt. The melt also passes through in-line degasser 220. In one embodiment, degasser 220 is configured to remove undesired gas species (e.g., hydrogen gas) from the melt. Following the filtering and degassing of the melt, the melt may be introduced to intermediate casting product forming station 240 where one or more intermediate casting products (e.g., billets, slabs) may be formed in, for example, a direct-chill casting process. Intermediate casting product forming station 240, in one embodiment, includes a direct chill casting system similar to system 5 in FIG. 1 and the accompanying text. Such system representatively includes but is not limited to a casting pit having top, intermediate and bottom portions; a mold located at the top portion of the casting pit, the mold including a reservoir therein; a molten metal detector operable to detect a bleed-out or run-out; an exhaust system operable to remove generated gases including ignition sources and reactants from a casting pit; a gas introduction system including an inert gas source operable to provide inert gas to a casting pit; air-introduction ports operable to introduce air into a casting pit; a collection system operable to collect inert gas exiting the casting pit (e.g., through the exhaust system) and to remove constituents (e.g., steam) from the inert gas; and a recirculation system to recirculate the collected inert gas. In one embodiment, the direct chill casting system includes a coolant feed system that includes a valve system connected to a conduit feed such as illustrated in FIG. 2 and FIG. 3. The valve system includes a first valve operable to modulate a flow of coolant (e.g., water) from a coolant source and a second valve to modulate a flow of an inert fluid from an inert fluid source(s).

The system described above may be controlled by a controller. In one embodiment, controller 290 is configured to control the operation of system 200. Accordingly, various units such as induction furnace 205; first filter 215; degasser 220; second filter 225; and intermediate casting product forming station 240 are electrically connected to controller 290 either through wires or wirelessly. In one embodiment, controller 290 contains machine-readable program instructions as a form of non-transitory media. In one embodiment, the program instructions perform a method of melting a charge in induction furnace 205 and delivering the melt to intermediate casting product forming station 240. With regard to melting the charge, the program instructions include, for example, instructions for stirring the melt, operating the induction coil and circulating gas through the gap between the induction coil and melt-containing vessel 230. In an embodiment, where a charging apparatus includes a stirring means or mixing means, such program instructions include instructions for stirring or agitating the melt. With regard to delivering the melt to intermediate casting product forming station 240, such instructions include instructions for establishing a flow of the melt from induction furnace 205 through the fillers and degassers. At intermediate casting product forming station 240, the instructions direct the formation of one or more billets or slabs. With regard to forming one or more billets, the program instructions include, for example, instructions to lower the one or more casting cylinders 295 and spraying coolant 297 to solidify the metal alloy cast.

In one embodiment, controller 290 also regulates and monitors the system. Such regulation and monitoring may be accomplished by a number of sensors throughout the system that either send signals to controller 290 or are queried by controller 290. For example, with reference to induction furnace 205, such monitors may include one or more temperature gauges/thermocouples associated with melt-containing vessel 230 and/or upper furnace vessel 210. Other monitors include temperature monitor 280 associated with gas circulation subsystem 250 that provides the temperature of a gas (e.g., inert gas) introduced into the gap between melt-containing vessel 230 and inside surface of the induction coil. By monitoring a temperature of the circulation gas, a freeze plane associated with melt-containing vessel 230 may be maintained at a desired position. In one embodiment, a temperature of an exterior surface of melt-containing vessel may also be measured and monitored by controller 290 by placing a thermocouple adjacent to the exterior surface of melt-containing vessel 230 (thermocouple 344). Another monitor associated with gas circulation subsystem 250 is associated with hydrogen analyzer 258. When hydrogen analyzer 258 detects an excess amount of hydrogen in the gas, a signal is sent to or detected by controller 290 and controller 290 opens vent valve 259. In one embodiment, controller 290 also controls the opening and closing of valves 251, 252 and 256 associated with gas circulation subsystem 250 when gas is supplied from gas source 255 (each of the valves are open) with, for example, a flow rate of gas controlled by the extent to which controller 290 opens the valves and, when ambient air is supplied from blower 258, each of the valves are closed and air feed valve 253 and air discharge valve 257 are open. In one embodiment, where air is circulated through the gap, controller 290 may regulate the velocity of blower 258 and/or the amount feed valve 253 is open to regulate a temperature of an exterior surface of melt-containing vessel 230 based, for example, on a temperature measurement from thermocouple 344 adjacent an exterior of melt-containing vessel 230. A further monitor includes, for example, probes associated with a bleed out detection subsystem associated with induction furnace 205. With regard to the overall system 200, additional monitors may be provided to, for example, monitor the system for a molten metal bleed out or run out. With respect to monitoring and controlling a bleed-out or run-out at intermediate casting product forming station 240, in one embodiment, controller 290 monitors and/or controls at least the flow of coolant to a reservoir of a casting mold, a flow of inert gas to the reservoir of the casting mold, a movement of a platen in the casting pit, the exhaust system, the gas (e.g., inert gas) introduction system and the recirculation system.

The above-described system may be used to form billets or slabs or other intermediate casting product forms that may be used in various industries, including, but not limited to, automotive, sports, aeronautical and aerospace industries. The illustrated system shows a system for forming billets or slabs by a direct-chill casting process. Slabs or other than round or rectangular may alternatively be formed in a similar system. The formed billets may be used, for example, to extrude or forge desired components for aircraft, for automobiles or for any industry utilizing extruded metal parts. Similarly, slabs or other forms of castings may be used to form components such as components for automotive, aeronautical or aerospace industries such as by rolling or forging.

The above-described system illustrates one induction furnace feeding intermediate casting product forming station 240. In another embodiment, a system may include multiple induction furnaces and, representatively, multiple gas circulation subsystems including multiple source gases, multiple filters and degassers.

There has thus been described a commercially useful method and apparatus for minimizing the potential for explosions in the direct chill casting of Al—Li alloys. It is appreciated that though described for Al—Li alloys, the method and apparatus can be used in the casting of other metals and alloys.

It will be appreciated that several of the above-disclosed and other features and functions, or alternatives or varieties thereof, may be desirably combined into many other different systems or applications. Also that various alternatives, modifications, variations or improvements therein may be subsequently made by those skilled in the art which are also intended to be encompassed by the following claims.

In the description above, for the purposes of explanation, numerous specific requirements and several specific details have been set forth in order to provide a thorough understanding of the embodiments. It will be apparent however, to one skilled in the art, that one or more other embodiments may be practiced without some of these specific details. The particular embodiments described are not provided to limit the invention but to illustrate it. The scope of the invention is not to be determined by the specific examples provided above but only by the claims below. In other instances, well-known structures, devices, and operations have been shown in block diagram form or without detail in order to avoid obscuring the understanding of the description. Where considered appropriate, reference numerals or terminal portions of reference numerals have been repeated among the figures to indicate corresponding or analogous elements, which may optionally have similar characteristics.

It should also be appreciated that reference throughout this specification to "one embodiment", "an embodiment", "one or more embodiments", or "different embodiments", for example, means that a particular feature may be included in the practice of the invention. Similarly, it should be appreciated that in the description various features are sometimes grouped together in a single embodiment, figure, or description thereof for the purpose of streamlining the disclosure and aiding in the understanding of various inventive aspects. This method of disclosure, however, is not to be interpreted as reflecting an intention that the invention requires more features than are expressly recited in each claim. Rather, as the following claims reflect, inventive aspects may lie in less than all features of a single disclosed embodiment. In another situation, an inventive aspect may include a combination of embodiments described herein or in a combination of less than all aspects described in a combination of embodiments. Thus, the claims following the Detailed Description are hereby expressly incorporated into this Detailed Description, with each claim standing on its own as a separate embodiment of the invention.

What is claimed is:

1. A method for a direct chill casting of an aluminum lithium alloy wherein a molten metal is introduced into a casting mold and cooled by the impingement of a coolant on the solidifying metal in a casting pit having top, intermediate and bottom portions and including a movable platen comprising:

detecting a bleed out or a run out; and after detecting a bleed out or run out:

exhausting generated gas from the casting pit at a flow volume rate that is enhanced relative to a flow volume rate prior to detecting bleed out or run out; while exhausting generated gas, introducing an inert gas into the casting pit, the inert gas having a density less than a density of air;

introducing an inert fluid into a coolant feed associated with the casting mold; and stopping a flow of coolant to the coolant feed.

2. The method of claim 1, wherein the inert fluid comprises a helium gas or a mixture of a helium gas and an argon gas.

3. The method of claim 1, wherein exhausting generated gas from the casting pit comprises exhausting by an array of exhaust ports about at least a periphery of a top portion of the casting pit.

4. The method of claim 3, wherein exhausting generated gas further comprises exhausting by arrays of exhaust ports about the intermediate and bottom portions of the casting pit.

5. The method of claim 1, wherein introducing an inert gas comprises introducing an inert gas through an array of gas introduction ports about a periphery of at least a top portion of the casting pit.

6. The method of claim 1, wherein introducing an inert gas comprises introducing an inert gas through arrays of gas introduction ports about a periphery of a top portion, an intermediate portion and a bottom portion of the casting pit.

7. The method of claim 1, further comprising, after detecting a bleed out or run out, stopping a flow of molten metal into the casting mold.

8. The method of claim 1, wherein the inert fluid is helium gas.

9. The method of claim 1, wherein the inert fluid is a mixture of a helium gas and an argon gas.

10. The method of claim 1, wherein the inert fluid is a mixture of a helium gas and an argon gas comprising at least about 20% of the helium gas.

11. The method of claim 1, wherein the inert fluid is a mixture of a helium gas and an argon gas comprising at least about 60% of the helium gas.

12. The method of claim 1, wherein a bleed out or a run out comprises detecting a bleed out or run out of a lithium-aluminum alloy.

13. The method of claim 12, wherein the lithium aluminum alloy comprises about 0.1 percent to six percent lithium.

14. The method of claim 12, wherein the lithium aluminum alloy comprises properties to meet a requirement of 100,000 pounds per square inch ("psi") tensile strength and 80,000 psi yield strength.

15. The method of claim 1, wherein prior to detecting a bleed out or a run out, the method comprises extruding a product of the molten metal comprising lithium-aluminum alloy.

16. The method of claim 15, wherein the product is a component for an aircraft or an automobile.

* * * * *